United States Patent [19]

Shaffer

[11] Patent Number: 5,006,762

[45] Date of Patent: Apr. 9, 1991

[54] NEGATIVE GLOW FLUORESCENT LAMP HAVING DISCHARGE BARRIER

[75] Inventor: John W. Shaffer, Danvers, Mass.

[73] Assignee: GTE Products Corporation, Danvers, Mass.

[21] Appl. No.: 506,149

[22] Filed: Apr. 9, 1990

[51] Int. Cl.[5] ..... H01J 61/10; H05B 37/00

[52] U.S. Cl. ..... 315/205; 315/51; 315/101; 315/105; 313/492; 313/619

[58] Field of Search ..... 315/101, 105, 205, 51, 315/DIG. 5, 71, 58; 313/492, 619, 622, 614, 616, 609

[56] References Cited

U.S. PATENT DOCUMENTS

| | | | |
|---|---|---|---|
| 1,991,279 | 2/1935 | Holst | 313/616 |
| 1,994,733 | 3/1935 | Thompson | 313/492 X |
| 2,283,216 | 5/1942 | Lowry | 313/616 X |
| 2,549,355 | 4/1951 | Winninghoff | 313/492 |
| 2,959,702 | 11/1960 | Beese | 313/492 |
| 3,771,018 | 11/1973 | Medendorp et al. | 315/51 X |
| 3,814,971 | 6/1974 | Bhattacharya | 313/643 |
| 3,987,336 | 10/1976 | van der Meulen | 315/101 |
| 4,122,374 | 10/1978 | Stüdli | 315/101 X |
| 4,408,141 | 10/1983 | Byszewski et al. | 315/56 |
| 4,413,204 | 11/1983 | Byszewski et al. | 315/67 X |
| 4,450,380 | 5/1984 | Proud et al. | 313/485 |
| 4,465,954 | 8/1984 | Barakitis et al. | 315/101 X |
| 4,516,057 | 5/1985 | Proud et al. | 315/260 |
| 4,518,897 | 5/1985 | Proud et al. | 315/260 |
| 4,629,943 | 12/1986 | Ponce, Jr. | 315/51 X |
| 4,751,435 | 6/1988 | Roche et al. | 315/56 X |
| 4,866,339 | 9/1989 | Budinger et al. | 313/616 X |
| 4,879,493 | 11/1989 | Mastuno et al. | 313/619 X |
| 4,904,900 | 2/1990 | Bouchard et al. | 313/619 X |
| 4,952,844 | 8/1990 | Godyak et al. | 315/205 |

*Primary Examiner*—Eugene R. LaRoche
*Assistant Examiner*—Do Hyun Yoo
*Attorney, Agent, or Firm*—Carlo S. Bessone

[57] ABSTRACT

A negative glow fluorescent lamp includes a light-transmissive envelope enclosing a fill material which emits ultraviolet radiation upon excitation, a phosphor coating on an inner surface of the envelope, the phosphor coating emitting visible light upon absorption of ultraviolet radiation, a cathode located within the envelope for emitting electrons, first and second cathode leads extending through the envelope, an anode located in the envelope and spaced from the cathode for collecting electrons and first and second diodes coupled between opposite ends of the anode and the first and second cathode leads, respectively. The glow lamp can include one or more insulating discharge barriers which surround the cathode and block electron bombardment of the cathode during positive half cycles of the AC voltage. The discharge barriers are preferably as large in area as is practical and can be coated with an ultraviolet-reflecting material or with a phosphor layer. The glow lamp operates from an AC voltage and requires only two electrical connections. Lumen maintenance is improved because electron bombardment of the cathode is eliminated. A simple, low-cost ballast can be utilized.

25 Claims, 2 Drawing Sheets

NEGATIVE GLOW FLUORESCENT LAMP HAVING DISCHARGE BARRIER

CROSS REFERENCE TO RELATED APPLICATION

This application discloses but does not claim, subject matter which is claimed in U.S. Ser. No. 07/506,150 filed concurrently herewith and assigned to the assignee of this application.

FIELD OF THE INVENTION

This invention relates to negative glow fluorescent lamps and, more particularly, to a negative glow fluorescent lamp having a discharge barrier for suppressing electron bombardment of the cathode.

BACKGROUND OF THE INVENTION

Conventional AC-operated, negative glow fluorescent lamps include a light-transmitting envelope that is filled with an inert gas, such as a mixture of 99.5% neon and 0.5% argon at a pressure of about 2 torr, and approximately 12 milligrams of mercury. The inner surface of the lamp envelope is coated with a fluorescent phosphor. Two tungsten filament electrodes coated with an electron emissive coating are mounted within the lamp envelope. A pair of electrical leads connected to each electrode pass through the lamp envelope and are connected to a power supply. The power supply provides low voltage heater current for each of the electrodes and provides an AC operating voltage between the two electrodes.

During lamp operation, a negative glow discharge is set up between the electrodes. During the two halves of the applied AC voltage cycle, the electrodes alternately act as cathodes and anodes. Electrons emitted from the electrode which is acting as a cathode are accelerated by the cathode fall potential and excite mercury atoms in the lamp, thereby causing emission of ultraviolet radiation. The ultraviolet radiation excites the phosphor coating on the lamp envelope which, in turn, emits visible light of a desired color.

Several disadvantages are associated with conventional AC negative glow fluorescent lamps as described above. Electron impingement upon the electrode which is acting as an anode causes locally high temperatures and volatilization of the emissive coating. Lamp lumen output degrades due to deposition of emissive coating substances on the phosphor layer, and lamp life is shortened by loss of the required emissive coating from the electrodes. In addition, a relatively complex and costly power supply is required, and a four-connection interface between the lamp and the power supply is required.

A prior art glow lamp is disclosed in U.S. Pat. No. 3,814,971, issued June 4, 1974 to Bhattacharya. Beam mode fluorescent lamps are disclosed in U.S. Pat. No. 4,408,141, issued Oct. 4, 1983 to Byszewski et al; U.S. Pat. No. 4,413,204, issued Nov. 1, 1983 to Byszewski et al; U.S. Pat. No. 4,450,380, issued May 22, 1984 to Proud et al; U.S. Pat. No. 4,518,897, issued May 21, 1985 to Proud et al; U.S. Pat. No. 4,516,057, issued May 7, 1985 to Proud et al; and U.S. Pat. No. 4,751,435, issued June 14, 1988 to Roche et al.

DC-operated, negative glow fluorescent lamps are also known in the art. Such lamps include an electron-emissive cathode and an anode. A heater current is supplied through the cathode, and a DC voltage is applied between the anode and the cathode. While the cathode emissive coating is not bombarded by electrons in the DC-operated lamp, the power supply for such a lamp is relatively expensive and inefficient. DC-operated, negative glow fluorescent lamps are disclosed in U.S. Pat. No. 4,904,900 issued Feb. 27, 1990 and assigned to the assignee of the present application.

It is a general object of the present invention to provide improved negative glow fluorescent lamps.

It is another object of the present invention to provide AC-operated, negative glow fluorescent lamps.

It is a further object of the present invention to provide AC-operated, negative glow fluorescent lamps in which cathode emissive coating bombardment by electrons is substantially reduced or eliminated.

It is yet another object of the present invention to provide negative glow fluorescent lamps having a long operating life.

SUMMARY OF THE INVENTION

According to the present invention, these and other objects and advantages are achieved in a negative glow fluorescent lamp comprising a light-transmissive envelope enclosing a fill material which emits ultraviolet radiation upon excitation, a phosphor coating on an inner surface of the envelope, the phosphor coating emitting visible light upon absorption of ultraviolet radiation, a cathode located in the envelope for emitting electrons, anode means located in the envelope and spaced from the cathode for collecting the electrons, means for coupling electrical energy through the envelope to the cathode, and one or more electrically-insulating discharge barriers disposed adjacent to the cathode for suppressing electron bombardment of the cathode when one end thereof is positively biased relative to the other end. At high lamp operating voltages, it is preferred to use multiple discharge barriers spaced along the cathode so that the cathode voltage gradient between adjacent barriers is less than a predetermined value, typically about 10 volts.

The discharge barrier preferably comprises a sheet of insulating material positioned generally perpendicular to an axis of a cathode. The discharge barrier is typically in the form of a generally flat washer having an aperture for receiving the cathode and can be fabricated of mica, glass, or fiberglass, or ceramic fiber paper, board or fabric. Preferably, the discharge barrier is as large in area as is practical so as to substantially divide the lamp envelope into two interior regions. The glow lamp can further include means for supporting the discharge barrier in the envelope.

In a preferred embodiment, first and second cathode leads are connected to opposite ends of the cathode and extend through the lamp envelope. First and second diodes are connected between opposite ends of the anode and the first and second cathode leads, respectively. In this configuration, the lamp requires only two electrical connections to an external ballast.

According to a further feature of the invention, the discharge barrier can be at least partially covered with an ultraviolet-reflecting material such as powdered aluminum oxide. Ultraviolet radiation incident upon the discharge barrier is reflected to the phosphor coating on the lamp envelope, thereby stimulating emission of visible light. According to another feature of the invention, the discharge barrier is at least partially covered with a phosphor material which emits light upon absorption of ultraviolet radiation.

BRIEF DESCRIPTION OF THE DRAWINGS

For a better understanding of the present invention, together with other and further objects, advantages and capabilities thereof, reference is made to the accompanying drawings which are incorporated herein by reference and in which.

DETAILED DESCRIPTION OF THE INVENTION

Figure 1:
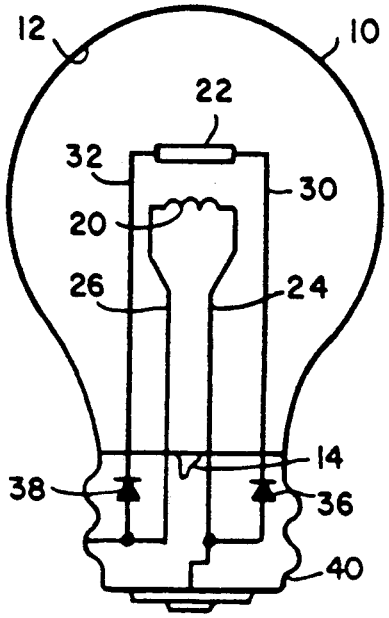
FIG. 1 is a simplified cross-sectional view of a negative glow fluorescent lamp in accordance with the present invention.

A negative glow fluorescent lamp in accordance with the present invention is shown in FIG. 1. A sealed lamp envelope 10 fabricated of a light-transmissive material such as lime glass has a phosphor coating 12 on its inner surface. The phosphor coating emits visible light upon excitation by ultraviolet radiation. Suitable phosphor coatings are well known in the art. The lamp envelope 10 includes an exhaust tip 14 for introduction of fill materials as described hereinafter.

A cathode 20 and an anode 22 are positioned within the lamp envelope 10. Cathode leads 24 and 26 extend from opposite ends of cathode 20 through lamp envelope 10. The leads 24 and 26 mechanically support the cathode 20 in the lamp envelope and conduct electrical power to the cathode. Anode leads 30 and 32 extend from opposite ends of anode 22 through lamp envelope 10. Anode lead 30 is connected to the cathode of a diode 36. Anode lead 32 is connected to the cathode of a diode 38. The anode of diode 36 is connected to cathode lead 24, and the anode of diode 38 is connected to cathode lead 26. The cathode leads 24 and 26 and the anode leads 30 and 32 are preferably a glass sealing alloy such as Alloy 52. By way of example, the diodes 36 and 38 can be type G2G made by General Instruments.

The lamp envelope 10 is mounted in a base 40. The base 40 mechanically supports lamp envelope 10 and provides means for connection of electrical power to the lamp. Cathode lead 24 is connected to one terminal of base 40, and cathode lead 26 is connected to the other terminal of base 40.

The cathode 20 is an electron emitter. In a preferred embodiment, the cathode is a standard tungsten, triple-coiled fluorescent emitter having an electron-emissive coating. A conventional coating includes barium, strontium and calcium oxides.

The anode 22 is preferably a conductive strip of a material which remains in a clean condition without oxidation in the lamp environment and which does not introduce contamination into the lamp envelope 10. In a preferred embodiment, the anode is a molybdenum foil attached at or near each end to anode leads 30 and 32 by spot welding. By way of example, the anode 22 can be formed as a molybdenum strip having dimensions of ⅝-inch by 3/16-inch by 0.004-inch thick. Nickel is also suitable as an anode material. The conductive foil or strip which comprises the anode is oriented with one of its flat surfaces facing cathode 20. In a preferred embodiment, the spacing between anode 22 and cathode 20 is about 1.2 centimeters.

The lamp envelope 10 contains a fill material which produces ultraviolet radiation upon excitation by electrons from cathode 20. A suitable fill material includes 99.5% neon and 0.5% argon at a pressure of about 1.5–2.0 torr and about 12–15 milligrams of metallic mercury. Other suitable fill materials include pure neon and mixtures containing neon, helium, argon and/or krypton. The lamp envelope 10 can have a volume on the order of approximately 200 cubic centimeters.

In operation, an open circuit AC voltage in the range of about 20 to 120 volts is applied between cathode leads 24 and 26. A preferred operating voltage is about 30 volts AC open circuit which provides a lamp voltage drop of about 15 volts. A current regulating ballast in the power supply provides a voltage drop of preferably one-half of the open circuit voltage. During operation, the anode 22 is alternately connected to cathode leads 24 and 26 by diodes 36 and 38, respectively. A negative glow discharge is set up between the cathode 20 and the anode 22. The glow discharge excites the mercury atoms in the fill gas. The ultraviolet radiation emitted by the mercury causes fluorescence of the phosphor coating 12 and emission of visible light.

Figure 2:
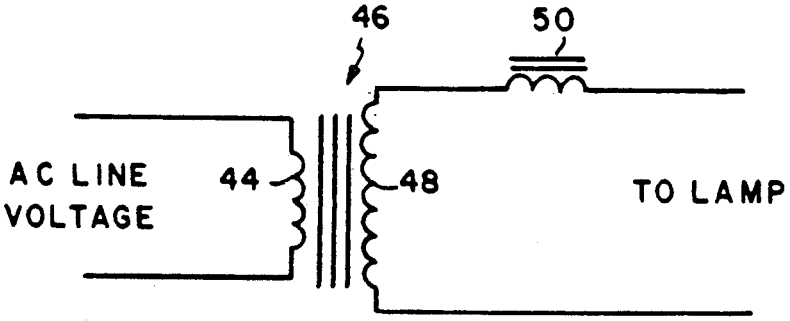
FIG. 2 is a schematic diagram of a lamp ballast suitable for operation of the lamp of FIG. 1.

A suitable power supply for operation of the lamp of the present invention is shown in FIG. 2. The AC line voltage is applied to a primary winding 44 of a step-down transformer 46. A secondary winding 48 is coupled through a current-limiting inductive ballast 50 to the terminals of the lamp.

Figure 3:
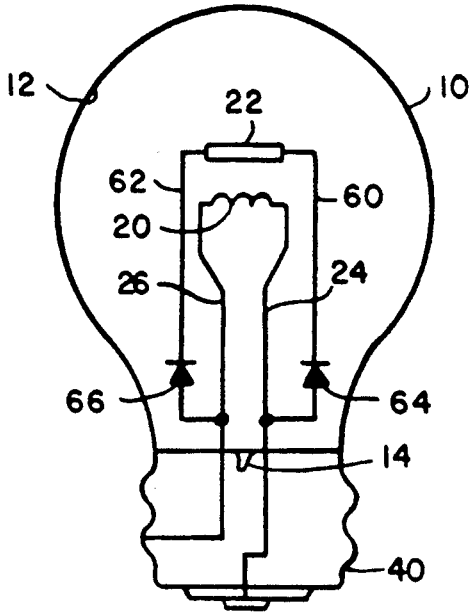
FIG. 3 is a simplified cross-sectional view of a lamp in accordance with an alternate embodiment of the present invention.

An alternate embodiment of the present invention is shown in FIG. 3. Like elements in FIGS. 1 and 3 have the same reference numerals. Anode 22 is connected by anode leads 60 and 62 to the cathodes of diodes 64 and 66, respectively, which are located within lamp envelope 10. The anodes of diodes 64 and 66 are connected to cathode leads 24 and 26, respectively. The embodiment shown in FIG. 3 has the advantage that only two electrical leads extend through the lamp envelope 10. However, diodes 64 and 66 are exposed to the lamp operating environment. Since the lamp operating voltage alternately appears across diodes 64 and 66, the possibility of arc discharge exists.

In the negative glow fluorescent lamps shown in FIGS. 1 and 3, the full AC lamp voltage is applied across the cathode 20. This voltage may be on the order of about 30 volts. The ends of the cathode 20 are positively biased on alternate half cycles of the applied AC voltage. Since the plasma surrounding the cathode 20 has a relatively low impedance, there exists the possibility that the current through the plasma partially bypasses the cathode 20. In this case, a region near the end of the cathode 20 that is positively biased with respect to the other end is bombarded with electrons, thereby causing erosion of the electron-emissive coating. As discussed above, erosion of the electron-emissive coating is undesirable and degrades lumen maintenance and life.

Figure 4:
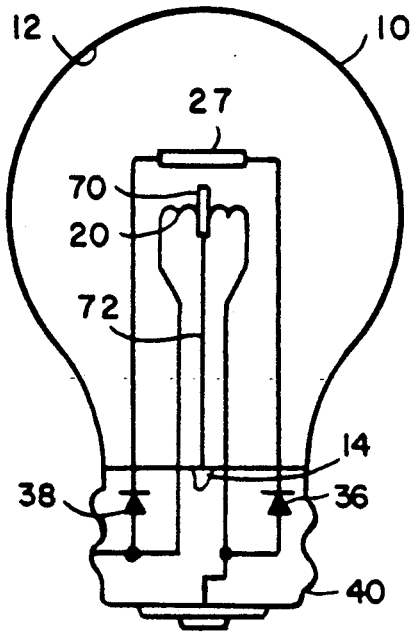
FIG. 4 is a simplified cross-sectional view of a negative glow fluorescent lamp which incorporates a discharge barrier.
Figure 4A:
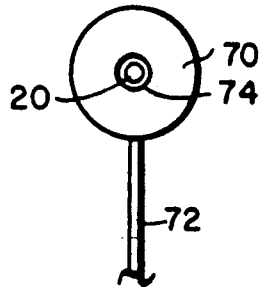
FIG. 4A is a partial cross-sectional view taken perpendicular to the cathode of FIG. 4, showing the discharge barrier.
Figure 5:
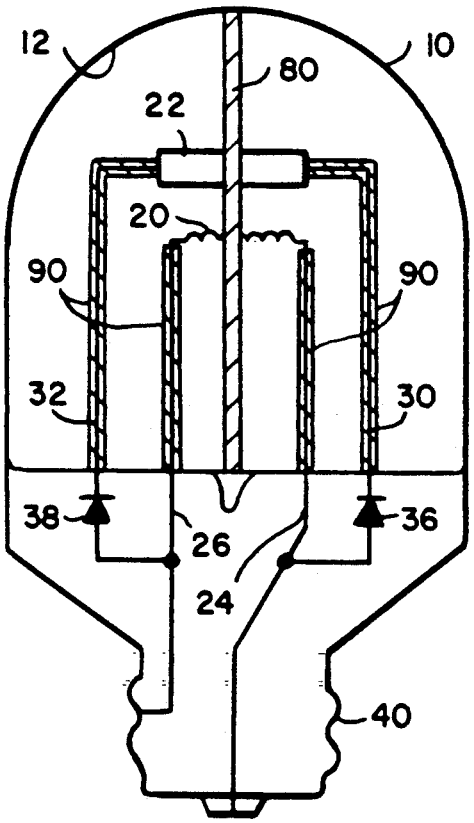
FIG. 5 is a simplified cross-sectional view of a negative glow fluorescent lamp which incorporates an alternate discharge barrier.
Figure 5A:
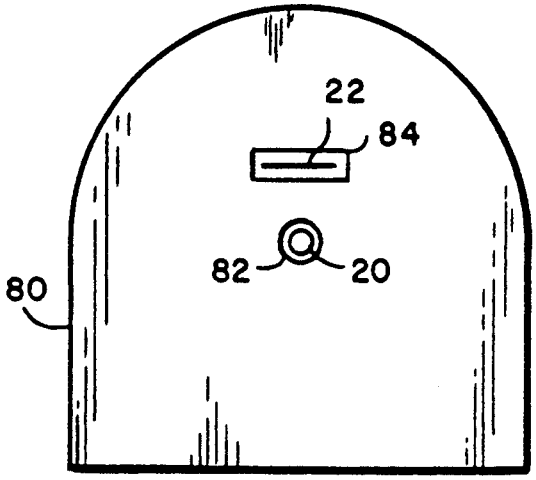
FIG. 5A is a partial cross-sectional view taken perpendicular to the cathode of FIG. 5, showing the discharge barrier.

Negative glow fluorescent lamps including means for suppressing such electron bombardment of the cathode ends are shown in FIGS. 4 and 5. Like elements in FIGS. 1, 4 and 5 have the same reference numerals. The lamp of FIG. 4 includes a discharge-suppressing barrier 70 attached to a support wire 72. The discharge barrier 70 comprises a sheet of electrically-insulating material surrounding the cathode 20. Preferably, the discharge barrier 70 is positioned approximately at the midpoint of cathode 20 and is oriented generally perpendicular to the long axis of cathode 20. As shown in FIG. 4A, the discharge barrier 70 has the form of an insulating washer with an aperture 74 through which the cathode 20 passes. The support wire 72 is attached at its lower end to envelope 10 so as to mechanically support the discharge barrier 70. The support wire 72 can be attached to discharge barrier 70 by crimping.

Figure 6:
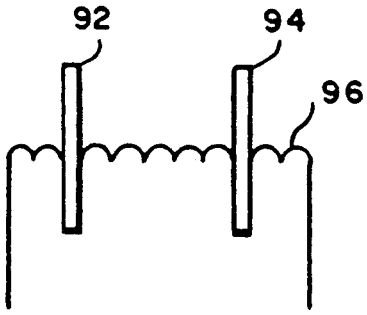
FIG. 6 is an enlarged view of a cathode having two discharge barriers.

The discharge barrier 70 resists the flow of current between the ends of cathode 20. The discharge barrier 70 is fabricated of an electrically-insulating material that is compatible with the operating environment in the interior of lamp envelope 10. Preferably, the discharge barrier 70 is an inorganic insulator such as mica, glass or fiberglass, or ceramic fiber board, paper, or fabric. Organic materials are likely to outgas and contaminate the lamp. Two or more spaced-apart discharge barriers can be utilized to suppress electron bombardment of cathode 20. At high lamp operating voltages, it is preferred to use multiple discharge barriers spaced along the cathode so that the cathode voltage gradient between adjacent barriers is less than a predetermined value, typically about 10 volts. As shown in FIG. 6, spaced-apart discharge barriers 92 and 94 are positioned on a cathode 96 such that the cathode voltage drop between discharge barriers 92 and 94 is less than about 10 volts.

The discharge barrier is preferably as large in area as is practical. A limiting factor on the area of the discharge barrier is usually the dimension of the neck of the lamp envelope 10. An embodiment of the negative glow fluorescent lamp having a relatively large area discharge barrier 80 is shown in FIG. 5. The discharge barrier 80 extends from the bottom region of lamp envelope 10 to the upper end of the lamp envelope. An aperture 82 is provided for the cathode 20, and an aperture 84 is provided for the anode 22. The discharge barrier 80 has a sufficiently large area to substantially divide the lamp envelope 10 into two regions and to effectively block electron bombardment of the cathode 20.

According to another feature of the lamp shown in FIG. 5, the cathode leads 24 and 26 and the anode leads 30 and 32 are provided with insulation 90, at least in a region adjacent to cathode 20 and anode 22, to further suppress electron bombardment. The insulation 90 can be a glass coating or an insulating sleeve. The insulation 90 is optional and can be utilized in the other embodiments of the invention shown and described herein, if desired.

The discharge barrier 70, 80 intercepts a portion of the ultraviolet radiation generated in the interior of lamp envelope 10. In accordance with another feature of the invention, the discharge barrier 70, 80 can be coated with an ultraviolet-reflective material such as powdered aluminum oxide. Thus, ultraviolet radiation incident upon the discharge barrier 70, 80 is reflected to phosphor layer 12, and the efficacy of the lamp is maintained. Alternatively, the discharge barrier 70, 80 can be coated with a layer of phosphor material. In this case, ultraviolet radiation incident upon the discharge barrier 70, 80 stimulates emission of visible light by the phosphor layer.

The diodes 36 and 38 are not necessarily located in lamp base 40. For example, the diodes 36 and 38 can be located completely external to the lamp assembly. In this case, the lamp assembly would require a four-terminal connection between the lamp and the fixture. This configuration avoids replacement of the diodes when the lamp is replaced in the fixture. However, the cost savings in this configuration is slight.

The negative glow fluorescent lamp of the present invention provides several significant advantages in comparison with prior art negative glow fluorescent lamps. Lamp life is increased because electron impingement upon the cathode is reduced or eliminated, thereby avoiding volatilization of the emissive coating on the cathode. Lamp lumen maintenance is improved because of a reduced flux of materials from the emissive coating to the phosphor layer. A simple two-lead interface between the lamp and the fixture is provided. A simpler and less expensive ballast is required. Lamp efficacy is increased because only a single electrode (cathode 20) must be heated with external power. In comparison with a DC-operated, negative glow fluorescent lamp having a single cathode and anode and requiring a full-wave bridge rectifier power supply, diode loss is reduced by one-half since the operating current of the lamp passes through only a single PN junction.

While there have been shown and described what are at present considered the preferred embodiments of the present invention, it will be obvious to those skilled in the art that various changes and modifications may be made therein without departing from the scope of the invention as defined by the appended claims.

I claim:

1. A negative glow fluorescent lamp comprising:

a light-transmissive envelope enclosing a fill material which emits ultraviolet radiation upon excitation;

a phosphor coating on an inner surface of said envelope, said phosphor coating emitting visible light upon absorption of ultraviolet radiation;

a cathode located in said envelope for emitting electrons;

anode means located in said envelope and spaced from said cathode for collecting said electrons;

means for coupling electrical energy through said envelope to said cathode and said anode means; and one or more electrically insulating discharge barriers disposed adjacent to said cathode for suppressing electron bombardment of said cathode when one end thereof is positively biased relative to the other end.

2. A negative glow fluorescent lamp as defined in claim 1 wherein said discharge barrier comprises a sheet of insulating material positioned generally perpendicular to an axis of said cathode.

3. A negative glow fluorescent lamp as defined in claim 2 wherein said discharge barrier includes an aperture for said cathode.

4. A negative glow fluorescent lamp as defined in claim 2 wherein said discharge barrier comprises an inorganic insulator.

5. A negative glow fluorescent lamp as defined in claim 2 wherein said discharge barrier is fabricated of a material selected from the group consisting of mica, glass, fiberglass and ceramic fiber paper, board or fabric.

6. A negative glow fluorescent lamp as defined in claim 3 wherein said discharge barrier includes an aperture for said anode.

7. A negative glow fluorescent lamp as defined in claim 1 wherein said discharge barrier comprises a generally flat washer having an aperture for receiving said cathode.

8. A negative glow fluorescent lamp as defined in claim 7 wherein said discharge barrier is positioned substantially at the midpoint of said cathode.

9. A negative glow fluorescent lamp as defined in claim 1 wherein said discharge barrier comprises an insulating sheet of sufficient area to substantially divide said envelope into two interior regions.

10. A negative glow fluorescent lamp as defined in claim 1 further including means for supporting said discharge barrier in said envelope.

11. A negative glow fluorescent lamp as defined in claim 10 wherein said means for supporting comprises a support wire attached between said discharge barrier and said envelope.

12. A negative glow fluorescent lamp as defined in claim 1 wherein said discharge barrier is at least partially covered with an ultraviolet reflecting material.

13. A negative glow fluorescent lamp as defined in claim 12 wherein said ultraviolet reflecting material comprises powdered aluminum oxide.

14. A negative glow fluorescent lamp as defined in claim 1 wherein said discharge barrier is at least partially covered with a phosphor material which emits visible light upon absorption of ultraviolet radiation.

15. A negative glow fluorescent lamp as defined in claim 1 wherein first and second electrical leads are connected to opposite ends of said cathode, said first and second electrical leads being insulated at least in a region near said cathode.

16. A negative glow fluorescent lamp as defined in claim 1 including at least two discharge barriers that are spaced apart such that the cathode voltage drop between adjacent discharge barriers does not exceed a predetermined value.

17. A negative glow fluorescent lamp comprising:

a light-transmissive envelope enclosing a fill material which emits ultraviolet radiation upon excitation;

a phosphor coating on an inner surface of said envelope, said phosphor coating emitting visible light upon absorption of ultraviolet radiation;

a cathode located in said envelope for emitting electrons;

first and second cathode leads extending through said envelope and connected to opposite ends of said cathode;

an anode located in said envelope and spaced from said cathode for collecting said electrons;

first and second diode means coupled between opposite ends of said anode and said first and second cathode leads, respectively;

one or more electrically-insulating discharge barriers disposed around said cathode for suppressing electron bombardment of said cathode when one end thereof is positively biased relative to the other end; and means for coupling AC power to said first and second cathode leads.

18. A negative glow fluorescent lamp as defined in claim 17 further including a lamp base for mounting said envelope, said first and second diode means being located in said lamp base such that only two electrical connections are required for coupling AC power to said lamp.

19. A negative glow fluorescent lamp as defined in claim 17 wherein said first diode means comprises a first diode having its anode electrically connected to said first cathode lead and said second diode means comprises a second diode having its anode electrically connected to said second cathode lead.

20. A negative glow fluorescent lamp as defined in claim 18 wherein said discharge barrier comprises a sheet of insulating material positioned generally perpendicular to an axis of said cathode.

21. A negative glow fluorescent lamp as defined in claim 17 further including means for supporting said discharge barrier in said envelope.

22. A negative glow fluorescent lamp as defined in claim 17 wherein said discharge barrier is at least partially covered with an ultraviolet reflecting material.

23. A negative glow fluorescent lamp as defined in claim 17 wherein said discharge barrier is at least partially covered with a phosphor material which emits visible light upon absorption of ultraviolet radiation.

24. A negative glow fluorescent lamp as defined in claim 17 wherein said discharge barrier is fabricated of a material selected from the group consisting of mica, glass, fiberglass and ceramic fiber paper, board or fabric.

25. A negative glow fluorescent lamp as defined in claim 17 including at least two discharge barriers that are spaced apart such that the cathode voltage drop between adjacent discharge barriers does not exceed a predetermined value.

* * * * *